US010604970B2

(12) United States Patent
Briggs et al.

(10) Patent No.: US 10,604,970 B2
(45) Date of Patent: Mar. 31, 2020

(54) METHOD TO DETECT END-OF-LIFE IN LATCHES

(71) Applicant: Ford Global Technologies, LLC, Dearborn, MI (US)

(72) Inventors: Erin Rose Briggs, Detroit, MI (US); Muhammad Omer Khan, Ypsilanti, MI (US); Kosta Papanikolaou, Huntington Woods, MI (US); Livianu Dorin Puscas, Rochester Hills, MI (US); Christopher Matthew Radjewski, Macomb, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 355 days.

(21) Appl. No.: 15/586,984

(22) Filed: May 4, 2017

(65) Prior Publication Data

US 2018/0320420 A1 Nov. 8, 2018

(51) Int. Cl.

| | |
|---|---|
| ***E05B 81/66*** | (2014.01) |
| ***E05B 81/68*** | (2014.01) |
| ***E05B 81/14*** | (2014.01) |
| ***E05B 15/04*** | (2006.01) |
| ***E05B 17/00*** | (2006.01) |

(Continued)

(52) U.S. Cl.

CPC ..... *E05B 81/66* (2013.01); *E05B 15/04* (2013.01); *E05B 17/0062* (2013.01); *E05B 39/04* (2013.01); *E05B 81/14* (2013.01); *E05B 81/68* (2013.01); *E05B 17/226* (2013.01); *G07C 5/0825* (2013.01)

(58) Field of Classification Search

CPC ..... E05B 81/66; E05B 81/64; E05B 15/04; E05B 17/0062; E05B 39/04; E05B 81/14; E05B 81/68; E05B 17/226; E05B 1/0084; E05B 19/0088; G07C 5/0825; G07C 3/00; G07C 5/00; G07C 5/0816; G07C 7/00

USPC ..... 292/201

See application file for complete search history.

(56) References Cited

U.S. PATENT DOCUMENTS

| | | | |
|---|---|---|---|
| 2,229,909 | A | 1/1941 | Wread |
| 2,553,023 | A | 5/1951 | Walters |

(Continued)

FOREIGN PATENT DOCUMENTS

| | | | |
|---|---|---|---|
| CN | 1232936 | C | 12/2005 |
| CN | 201198681 | Y | 2/2009 |

(Continued)

OTHER PUBLICATIONS

Zipcar.com, "Car Sharing from Zipcar: How Does car Sharing Work?" Feb. 9, 2016, 6 pages.

(Continued)

*Primary Examiner* — Nathan Cumar

(74) *Attorney, Agent, or Firm* — David Coppiellie; Price Heneveld LLP

(57) ABSTRACT

A door latch system for vehicle doors, deck lids, hatches, hoods, or the like includes a latch. The latch has a predicted life that may be based on a number of times the latch is used. A sensor that generates a signal that can be used to determine if the latch has reached the predicted life and/or if the latch is approaching the predicted life and/or if the latch has exceeded the predicted life. The system may include a controller that causes a display in a vehicle interior to display an end-of-life signal.

19 Claims, 5 Drawing Sheets

(51) Int. Cl.

| | |
|---|---|
| ***E05B 39/04*** | (2006.01) |
| *E05B 17/22* | (2006.01) |
| *G07C 5/08* | (2006.01) |

(56) References Cited

U.S. PATENT DOCUMENTS 3,479,767 A 11/1969 Gardner et al.
3,605,459 A 9/1971 Van Dalen
3,751,718 A 8/1973 Hanchett
3,771,823 A 11/1973 Schnarr
3,854,310 A 12/1974 Paull
3,858,922 A 1/1975 Yamanaka
4,193,619 A 3/1980 Jeril
4,206,491 A 6/1980 Ligman et al.
4,425,597 A 1/1984 Schramm
4,457,148 A 7/1984 Johansson et al.
4,640,050 A 2/1987 Yamagishi et al.
4,672,348 A 6/1987 Duve
4,674,230 A 6/1987 Takeo et al.
4,674,781 A 6/1987 Reece et al.
4,702,117 A 10/1987 Tsutsumi et al.
4,848,031 A 6/1989 Yamagishi et al.
4,858,971 A 8/1989 Haag
4,889,373 A 12/1989 Ward et al.
4,929,007 A 5/1990 Bartczak et al.
5,018,057 A 5/1991 Biggs et al.
5,056,343 A 10/1991 Kleefeldt et al.
5,058,258 A 10/1991 Harvey
5,074,073 A 12/1991 Zwebner
5,092,637 A 3/1992 Miller
5,173,991 A 12/1992 Carswell
5,239,779 A 8/1993 Deland et al.
5,263,762 A 11/1993 Long et al.
5,297,010 A 3/1994 Camarota et al.
5,332,273 A 7/1994 Komachi
5,334,969 A 8/1994 Abe et al.
5,494,322 A 2/1996 Menke
5,497,641 A 3/1996 Linde et al.
5,535,608 A 7/1996 Brin
5,547,208 A 8/1996 Chappell et al.
5,551,187 A 9/1996 Brouwer et al.
5,581,230 A 12/1996 Barrett
5,583,405 A 12/1996 Sai et al.
5,613,716 A 3/1997 Cafferty
5,618,068 A 4/1997 Mitsui et al.
5,632,120 A 5/1997 Shigematsu et al.
5,632,515 A 5/1997 Dowling
5,644,869 A 7/1997 Buchanan, Jr.
5,653,484 A 8/1997 Brackmann et al.
5,662,369 A 9/1997 Tsuge
5,684,470 A 11/1997 Deland et al.
5,744,874 A 4/1998 Yoshida et al.
5,755,059 A 5/1998 Schap
5,783,994 A 7/1998 Koopman, Jr. et al.
5,802,894 A 9/1998 Jahrsetz et al.
5,808,555 A 9/1998 Bartel
5,852,944 A 12/1998 Collard, Jr. et al.
5,859,417 A 1/1999 David
5,895,089 A 4/1999 Singh et al.
5,896,026 A 4/1999 Higgins
5,896,768 A 4/1999 Cranick et al.
5,898,536 A 4/1999 Won
5,901,991 A 5/1999 Hugel et al.
5,921,612 A 7/1999 Mizuki et al.
5,927,794 A 7/1999 Mobius
5,964,487 A 10/1999 Shamblin
5,979,754 A 11/1999 Martin et al.
5,992,194 A 11/1999 Baukholt et al.
6,000,257 A 12/1999 Thomas
6,027,148 A 2/2000 Shoemaker
6,038,895 A 3/2000 Menke et al.
6,042,159 A 3/2000 Spitzley et al.
6,043,735 A 3/2000 Barrett
6,050,117 A 4/2000 Weyerstall
6,056,076 A 5/2000 Bartel et al.
6,065,316 A 5/2000 Sato et al.
6,072,403 A 6/2000 Iwasaki et al.
6,075,294 A 6/2000 Van den Boom et al.
6,089,626 A 7/2000 Shoemaker
6,091,162 A 7/2000 Williams, Jr. et al.
6,099,048 A 8/2000 Salmon et al.
6,125,583 A 10/2000 Murray et al.
6,130,614 A 10/2000 Miller
6,145,918 A 11/2000 Wilbanks, II
6,157,090 A 12/2000 Vogel
6,181,024 B1 1/2001 Geil
6,198,995 B1 3/2001 Settles et al.
6,241,294 B1 6/2001 Young et al.
6,247,343 B1 6/2001 Weiss et al.
6,256,932 B1 7/2001 Jyawook et al.
6,271,745 B1 8/2001 Anazi et al.
6,305,737 B1 10/2001 Corder et al.
6,341,448 B1 1/2002 Murray
6,357,803 B1 3/2002 Lorek
6,361,091 B1 3/2002 Weschler
6,405,485 B1 6/2002 Itami et al.
6,406,073 B1 6/2002 Watanabe
6,441,512 B1 8/2002 Jakel et al.
6,460,905 B2 10/2002 Suss
6,470,719 B1 10/2002 Franz et al.
6,480,098 B2 11/2002 Flick
6,481,056 B1 11/2002 Jesse
6,515,377 B1 2/2003 Uberlein et al.
6,523,376 B2 2/2003 Baukholt et al.
6,535,116 B1 * 3/2003 Zhou ..... B60C 23/009 340/438
6,550,826 B2 4/2003 Fukushima et al.
6,554,328 B2 4/2003 Cetnar et al.
6,556,900 B1 * 4/2003 Brynielsson ..... G01D 1/14 701/31.4
6,602,077 B2 8/2003 Kasper et al.
6,606,492 B1 8/2003 Losey
6,629,711 B1 10/2003 Gleason et al.
6,631,293 B2 * 10/2003 Lyden ..... A61N 1/3708 607/29
6,639,161 B2 10/2003 Meagher et al.
6,657,537 B1 12/2003 Hauler
6,659,515 B2 12/2003 Raymond et al.
6,701,671 B1 3/2004 Fukumoto et al.
6,712,409 B2 3/2004 Monig
6,715,806 B2 4/2004 Arlt et al.
6,734,578 B2 5/2004 Konno et al.
6,740,834 B2 5/2004 Sueyoshi et al.
6,768,413 B1 7/2004 Kemmann et al.
6,779,372 B2 8/2004 Arlt et al.
6,783,167 B2 8/2004 Bingle et al.
6,786,070 B1 9/2004 Dimig et al.
6,794,837 B1 9/2004 Whinnery et al.
6,825,752 B2 11/2004 Nahata et al.
6,829,357 B1 12/2004 Alrabady et al.
6,843,085 B2 1/2005 Dimig
6,854,870 B2 2/2005 Huizenga
6,879,058 B2 4/2005 Lorenz et al.
6,883,836 B2 4/2005 Breay et al.
6,883,839 B2 4/2005 Belmond et al.
6,910,302 B2 6/2005 Crawford
6,914,346 B2 7/2005 Girard
6,923,479 B2 8/2005 Aiyama et al.
6,933,655 B2 8/2005 Morrison et al.
6,948,978 B2 9/2005 Schofield
7,005,959 B2 2/2006 Amagasa
7,038,414 B2 5/2006 Daniels et al.
7,055,997 B2 6/2006 Baek
7,062,945 B2 6/2006 Saitoh et al.
7,070,018 B2 7/2006 Kachouh
7,070,213 B2 7/2006 Willats et al.
7,090,285 B2 8/2006 Markevich et al.
7,091,823 B2 8/2006 Ieda et al.
7,091,836 B2 8/2006 Kachouh et al.
7,097,226 B2 8/2006 Bingle et al.
7,106,171 B1 9/2006 Burgess
7,108,301 B2 9/2006 Louvel
7,126,453 B2 10/2006 Sandau et al.
7,145,436 B2 12/2006 Ichikawa et al.

(56) References Cited

U.S. PATENT DOCUMENTS 7,161,152 B2 1/2007 Dipoala
7,170,253 B2 1/2007 Spurr et al.
7,173,346 B2 2/2007 Aiyama et al.
7,176,810 B2 2/2007 Inoue
7,180,400 B2 2/2007 Amagasa
7,192,076 B2 3/2007 Ottino
7,204,530 B2 4/2007 Lee
7,205,777 B2 4/2007 Schultz et al.
7,221,255 B2 5/2007 Johnson et al.
7,222,459 B2 5/2007 Taniyama
7,248,955 B2 7/2007 Hein et al.
7,263,416 B2 8/2007 Sakurai et al.
7,270,029 B1 9/2007 Papanikolaou et al.
7,325,843 B2 2/2008 Coleman et al.
7,342,373 B2 3/2008 Newman et al.
7,360,803 B2 4/2008 Parent et al.
7,363,788 B2 4/2008 Dimig et al.
7,375,299 B1 5/2008 Pudney
7,399,010 B2 7/2008 Hunt et al.
7,446,656 B2 11/2008 Steegmann
7,576,631 B1 8/2009 Bingle et al.
7,642,669 B2 1/2010 Spurr
7,686,378 B2 3/2010 Gisler et al.
7,688,179 B2 3/2010 Kurpinski et al.
7,705,722 B2 4/2010 Shoemaker et al.
7,747,286 B2 6/2010 Conforti
7,780,207 B2 8/2010 Gotou et al.
7,791,218 B2 9/2010 Mekky et al.
7,806,000 B2 * 10/2010 Land ..... H02H 1/0023 361/24
7,926,385 B2 4/2011 Papanikolaou et al.
7,931,314 B2 4/2011 Nitawaki et al.
7,937,893 B2 5/2011 Pribisic
8,028,375 B2 10/2011 Nakaura et al.
8,093,987 B2 1/2012 Kurpinski et al.
8,126,450 B2 2/2012 Howarter et al.
8,141,296 B2 3/2012 Bern
8,141,916 B2 3/2012 Tomaszewski et al.
8,169,317 B2 5/2012 Lemerand et al.
8,193,462 B2 6/2012 Zanini et al.
8,224,313 B2 7/2012 Howarter et al.
8,272,165 B2 9/2012 Tomioka
8,376,416 B2 2/2013 Arabia, Jr. et al.
8,398,128 B2 3/2013 Arabia et al.
8,405,515 B2 3/2013 Ishihara et al.
8,405,527 B2 3/2013 Chung et al.
8,419,114 B2 4/2013 Fannon
8,451,087 B2 5/2013 Krishnan et al.
8,454,062 B2 6/2013 Rohlfing et al.
8,474,889 B2 7/2013 Reifenberg et al.
8,532,873 B1 9/2013 Bambenek
8,534,101 B2 9/2013 Mette et al.
8,544,901 B2 10/2013 Krishnan et al.
8,573,657 B2 11/2013 Papanikolaou et al.
8,584,402 B2 11/2013 Yamaguchi
8,601,903 B1 12/2013 Klein et al.
8,616,595 B2 12/2013 Wellborn, Sr. et al.
8,648,689 B2 * 2/2014 Hathaway ..... B60K 28/12 292/216
8,690,204 B2 4/2014 Lang et al.
8,746,755 B2 6/2014 Papanikolaou et al.
8,826,596 B2 9/2014 Tensing
8,833,811 B2 9/2014 Ishikawa
8,903,605 B2 12/2014 Bambenek
8,915,524 B2 12/2014 Charnesky
8,963,701 B2 2/2015 Rodriguez
8,965,287 B2 2/2015 Lam
8,978,965 B2 * 3/2015 Longyear ..... E05D 13/1269 235/454
9,003,707 B2 4/2015 Reddmann
9,076,274 B2 * 7/2015 Kamiya ..... B60R 25/245
9,159,219 B2 10/2015 Magner et al.
9,184,777 B2 11/2015 Esselink et al.
9,187,012 B2 11/2015 Sachs et al.
9,189,900 B1 11/2015 Penilla et al.
9,260,882 B2 2/2016 Krishnan et al.
9,284,757 B2 3/2016 Kempel
9,322,204 B2 4/2016 Suzuki
9,353,566 B2 5/2016 Miu et al.
9,382,741 B2 7/2016 Konchan et al.
9,405,120 B2 8/2016 Graf
9,406,336 B2 * 8/2016 Bose ..... H04N 7/188
9,409,579 B2 * 8/2016 Eichin ..... B60W 50/0205
9,416,565 B2 8/2016 Papanikolaou et al.
9,475,369 B2 10/2016 Sugiura et al.
9,481,325 B1 11/2016 Lange
9,493,975 B1 11/2016 Li
9,518,408 B1 12/2016 Krishnan
9,522,590 B2 12/2016 Fujimoto et al.
9,546,502 B2 1/2017 Lange
9,551,166 B2 1/2017 Patel et al.
9,725,069 B2 8/2017 Krishnan
9,777,528 B2 10/2017 Elie et al.
9,797,178 B2 10/2017 Elie et al.
9,797,181 B2 10/2017 Wheeler et al.
9,834,964 B2 12/2017 Van Wiemeersch et al.
9,845,071 B1 12/2017 Krishnan
9,903,142 B2 2/2018 Van Wiemeersch et al.
9,909,344 B2 3/2018 Krishnan et al.
9,957,737 B2 5/2018 Patel et al.
2001/0005078 A1 6/2001 Fukushima et al.
2001/0030871 A1 10/2001 Anderson
2002/0000726 A1 1/2002 Zintler
2002/0111844 A1 8/2002 Vanstory et al.
2002/0121967 A1 9/2002 Bowen et al.
2002/0186144 A1 12/2002 Meunier
2003/0009855 A1 1/2003 Budzynski
2003/0025337 A1 2/2003 Suzuki et al.
2003/0038544 A1 2/2003 Spurr
2003/0101781 A1 6/2003 Budzynski et al.
2003/0107473 A1 6/2003 Pang et al.
2003/0111863 A1 6/2003 Weyerstall et al.
2003/0139155 A1 7/2003 Sakai
2003/0172695 A1 9/2003 Buschmann
2003/0182863 A1 * 10/2003 Mejean ..... E05B 81/66 49/26
2003/0184098 A1 10/2003 Aiyama
2003/0216817 A1 11/2003 Pudney
2004/0061462 A1 4/2004 Bent et al.
2004/0093155 A1 5/2004 Simonds et al.
2004/0124708 A1 7/2004 Giehler et al.
2004/0195845 A1 10/2004 Chevalier
2004/0217601 A1 11/2004 Gamault et al.
2005/0057047 A1 3/2005 Kachouch
2005/0068712 A1 3/2005 Schulz et al.
2005/0206173 A1 * 9/2005 Lim ..... E05B 83/16 292/216
2005/0216133 A1 9/2005 MacDougall et al.
2005/0218913 A1 10/2005 Inaba
2006/0056663 A1 3/2006 Call
2006/0100002 A1 5/2006 Luebke et al.
2006/0186987 A1 8/2006 Wilkins
2007/0001467 A1 1/2007 Muller et al.
2007/0090654 A1 4/2007 Eaton
2007/0115191 A1 5/2007 Hashiguchi et al.
2007/0120645 A1 5/2007 Nakashima
2007/0126243 A1 6/2007 Papanikolaou et al.
2007/0132553 A1 6/2007 Nakashima
2007/0170727 A1 7/2007 Kohlstrand et al.
2008/0021619 A1 1/2008 Steegmann et al.
2008/0060393 A1 3/2008 Johansson et al.
2008/0068129 A1 3/2008 Ieda et al.
2008/0129446 A1 6/2008 Vader
2008/0143139 A1 6/2008 Bauer et al.
2008/0202912 A1 8/2008 Boddie et al.
2008/0203737 A1 8/2008 Tomaszewski et al.
2008/0211623 A1 9/2008 Scheurich
2008/0217956 A1 9/2008 Gschweng et al.
2008/0224482 A1 * 9/2008 Cumbo ..... E05B 77/02 292/216
2008/0230006 A1 9/2008 Kirchoff et al.
2008/0250718 A1 10/2008 Papanikolaou et al.
2008/0296927 A1 12/2008 Gisler et al.
2008/0303291 A1 12/2008 Spurr

(56) References Cited

U.S. PATENT DOCUMENTS

| | | | |
|---|---|---|---|
| 2008/0307711 | A1 | 12/2008 | Kern et al. |
| 2009/0033104 | A1 | 2/2009 | Konchan et al. |
| 2009/0033477 | A1 | 2/2009 | Illium et al. |
| 2009/0145181 | A1 | 6/2009 | Pecoul et al. |
| 2009/0160211 | A1 | 6/2009 | Kirshnan et al. |
| 2009/0177336 | A1 | 7/2009 | McClellan et al. |
| 2009/0240400 | A1 | 9/2009 | Lachapelle et al. |
| 2009/0257241 | A1 | 10/2009 | Meinke et al. |
| 2010/0007463 | A1 | 1/2010 | Dingman et al. |
| 2010/0005233 | A1 | 3/2010 | Arabia et al. |
| 2010/0052337 | A1 | 3/2010 | Arabia, Jr. et al. |
| 2010/0060505 | A1 | 3/2010 | Witkowski |
| 2010/0097186 | A1 | 4/2010 | Wielebski |
| 2010/0175945 | A1 | 7/2010 | Helms |
| 2010/0235057 | A1 | 9/2010 | Papanikolaou et al. |
| 2010/0235058 | A1 | 9/2010 | Papanikolaou et al. |
| 2010/0235059 | A1 | 9/2010 | Krishnan et al. |
| 2010/0237635 | A1 | 9/2010 | Ieda et al. |
| 2010/0253535 | A1 | 10/2010 | Thomas |
| 2010/0265034 | A1 | 10/2010 | Cap et al. |
| 2010/0315267 | A1 | 12/2010 | Chung et al. |
| 2011/0041409 | A1 | 2/2011 | Newman et al. |
| 2011/0060480 | A1 | 3/2011 | Mottla et al. |
| 2011/0148575 | A1 | 6/2011 | Sobecki et al. |
| 2011/0154740 | A1 | 6/2011 | Matsumoto et al. |
| 2011/0180350 | A1 | 7/2011 | Thacker |
| 2011/0203181 | A1 | 8/2011 | Magner et al. |
| 2011/0203336 | A1 | 8/2011 | Mette et al. |
| 2011/0227351 | A1 | 9/2011 | Grosedemouge |
| 2011/0248862 | A1 | 10/2011 | Budampati |
| 2011/0252845 | A1 | 10/2011 | Webb et al. |
| 2011/0254292 | A1 | 10/2011 | Ishii |
| 2011/0313937 | A1 | 12/2011 | Moore, Jr. et al. |
| 2012/0119524 | A1 | 5/2012 | Bingle et al. |
| 2012/0154292 | A1 | 6/2012 | Zhao et al. |
| 2012/0180394 | A1 | 7/2012 | Shinohara |
| 2012/0205925 | A1 | 8/2012 | Muller et al. |
| 2012/0228886 | A1 | 9/2012 | Muller et al. |
| 2012/0252402 | A1 | 10/2012 | Jung |
| 2013/0049403 | A1 | 2/2013 | Fannon et al. |
| 2013/0069761 | A1 | 3/2013 | Tieman |
| 2013/0079984 | A1 | 3/2013 | Aerts et al. |
| 2013/0104459 | A1 | 5/2013 | Patel et al. |
| 2013/0127180 | A1 | 5/2013 | Heberer et al. |
| 2013/0138303 | A1 | 5/2013 | McKee et al. |
| 2013/0207794 | A1 | 8/2013 | Patel |
| 2013/0282226 | A1 | 10/2013 | Pollmann |
| 2013/0295913 | A1 | 11/2013 | Matthews, III et al. |
| 2013/0311046 | A1 | 11/2013 | Heberer et al. |
| 2013/0321065 | A1 | 12/2013 | Salter et al. |
| 2013/0325521 | A1 | 12/2013 | Jameel |
| 2014/0000165 | A1 | 1/2014 | Patel et al. |
| 2014/0007404 | A1 | 1/2014 | Krishnan et al. |
| 2014/0015637 | A1 | 1/2014 | Dassanakake et al. |
| 2014/0088825 | A1 | 3/2014 | Lange et al. |
| 2014/0129113 | A1 | 5/2014 | Van Wiemersch et al. |
| 2014/0150581 | A1 | 6/2014 | Scheuring et al. |
| 2014/0156111 | A1 | 6/2014 | Ehrman |
| 2014/0188999 | A1 | 7/2014 | Leonard et al. |
| 2014/0200774 | A1 | 7/2014 | Lange et al. |
| 2014/0227980 | A1 | 8/2014 | Esselink et al. |
| 2014/0242971 | A1 | 8/2014 | Aladenize et al. |
| 2014/0245666 | A1 | 9/2014 | Ishida et al. |
| 2014/0256304 | A1 | 9/2014 | Frye et al. |
| 2014/0278599 | A1 | 9/2014 | Reh |
| 2014/0293753 | A1 | 10/2014 | Pearson |
| 2014/0338409 | A1 | 11/2014 | Kraus et al. |
| 2014/0347163 | A1 | 11/2014 | Banter et al. |
| 2015/0001926 | A1 | 1/2015 | Kageyama et al. |
| 2015/0048927 | A1 | 2/2015 | Simmons |
| 2015/0059250 | A1 | 3/2015 | Miu et al. |
| 2015/0084739 | A1 | 3/2015 | Lemoult et al. |
| 2015/0149042 | A1 | 5/2015 | Cooper et al. |
| 2015/0161832 | A1 | 6/2015 | Esselink et al. |
| 2015/0197205 | A1 | 7/2015 | Xiong |
| 2015/0240548 | A1 | 8/2015 | Bendel et al. |
| 2015/0294518 | A1 | 10/2015 | Peplin |
| 2015/0330112 | A1 | 11/2015 | Van Wiemeersch et al. |
| 2015/0330113 | A1 | 11/2015 | Van Wiemeersch et al. |
| 2015/0330114 | A1 | 11/2015 | Linden et al. |
| 2015/0330117 | A1 | 11/2015 | Van Wiemeersch et al. |
| 2015/0330133 | A1 | 11/2015 | Konchan et al. |
| 2015/0360545 | A1 | 12/2015 | Nania |
| 2015/0371031 | A1 | 12/2015 | Ueno et al. |
| 2016/0060909 | A1 | 3/2016 | Krishnan et al. |
| 2016/0130843 | A1 | 5/2016 | Bingle |
| 2016/0138306 | A1 | 5/2016 | Krishnan et al. |
| 2016/0153216 | A1 | 6/2016 | Funahashi et al. |
| 2016/0273255 | A1 | 9/2016 | Suzuki et al. |
| 2016/0326779 | A1 | 11/2016 | Papanikolaou et al. |
| 2016/0339757 | A1* | 11/2016 | Gussen ..... B60G 17/0185 |
| 2017/0014039 | A1 | 1/2017 | Pahlevan et al. |
| 2017/0022742 | A1 | 1/2017 | Seki et al. |
| 2017/0058588 | A1 | 3/2017 | Wheeler et al. |
| 2017/0074006 | A1 | 3/2017 | Patel et al. |
| 2017/0247016 | A1 | 8/2017 | Krishnan |
| 2017/0270490 | A1 | 9/2017 | Penilla et al. |
| 2017/0306662 | A1 | 10/2017 | Och et al. |
| 2017/0349146 | A1 | 12/2017 | Krishnan |
| 2018/0038147 | A1 | 2/2018 | Linden et al. |
| 2018/0051493 | A1 | 2/2018 | Krishnan et al. |
| 2018/0051498 | A1 | 2/2018 | Van Wiemeersch et al. |
| 2018/0058128 | A1 | 3/2018 | Khan et al. |
| 2018/0065598 | A1 | 3/2018 | Krishnan |
| 2018/0080270 | A1 | 3/2018 | Khan et al. |
| 2018/0128022 | A1 | 5/2018 | Van Wiemeersh et al. |

FOREIGN PATENT DOCUMENTS

| | | | |
|---|---|---|---|
| CN | 201280857 | Y | 7/2009 |
| CN | 101527061 | A | 9/2009 |
| CN | 201567872 | U | 9/2010 |
| CN | 101932466 | A | 12/2010 |
| CN | 201915717 | U | 8/2011 |
| CN | 202200933 | U | 4/2012 |
| CN | 202686247 | U | 1/2013 |
| CN | 103206117 | A | 7/2013 |
| CN | 103264667 | A | 8/2013 |
| CN | 203511548 | U | 4/2014 |
| CN | 204326814 | U | 5/2015 |
| DE | 4403655 | A1 | 8/1995 |
| DE | 19620059 | A1 | 11/1997 |
| DE | 19642698 | A1 | 4/1998 |
| DE | 19642698 | A2 | 11/2000 |
| DE | 10212794 | A1 | 6/2003 |
| DE | 20121915 | U1 | 11/2003 |
| DE | 10309821 | A1 | 9/2004 |
| DE | 102005041551 | A1 | 3/2007 |
| DE | 102006029774 | A1 | 1/2008 |
| DE | 102006040211 | A1 | 3/2008 |
| DE | 102006041928 | A1 | 3/2008 |
| DE | 102010052582 | A1 | 5/2012 |
| DE | 102011051165 | A1 | 12/2012 |
| DE | 102015101164 | A1 | 7/2015 |
| DE | 102014107809 | A1 | 12/2015 |
| EP | 0372791 | A2 | 6/1990 |
| EP | 0694664 | A1 | 1/1996 |
| EP | 1162332 | A1 | 12/2001 |
| EP | 1284334 | A1 | 2/2003 |
| EP | 1288403 | A2 | 3/2003 |
| EP | 1284334 | A1 | 9/2003 |
| EP | 1460204 | A2 | 9/2004 |
| EP | 1465119 | A1 | 10/2004 |
| EP | 1338731 | A2 | 2/2005 |
| EP | 1944436 | A2 | 7/2008 |
| EP | 2053744 | A2 | 4/2009 |
| EP | 2314803 | A2 | 4/2011 |
| FR | 2698838 | A1 | 6/1994 |
| FR | 2783547 | A1 | 3/2000 |
| FR | 2841285 | A1 | 12/2003 |
| FR | 2860261 | A1 | 4/2005 |
| FR | 2948402 | A1 | 7/2009 |
| FR | 2955604 | A1 | 7/2011 |
| GB | 2402840 | A | 12/2004 |

(56) References Cited

FOREIGN PATENT DOCUMENTS

| | | | |
|---|---|---|---|
| GB | 2496754 | A | 5/2013 |
| JP | 62255256 | A | 11/1987 |
| JP | 05059855 | A | 3/1993 |
| JP | 406167156 | A | 6/1994 |
| JP | 406185250 | A | 7/1994 |
| JP | 2000064685 | A | 2/2000 |
| JP | 2000314258 | A | 11/2000 |
| JP | 2007100342 | A | 4/2007 |
| JP | 2007138500 | A | 6/2007 |
| KR | 20030025738 | A | 3/2003 |
| KR | 20120108580 | A | 10/2012 |
| WO | 0123695 | A1 | 4/2001 |
| WO | 03095776 | A1 | 11/2003 |
| WO | 2013111615 | A1 | 8/2013 |
| WO | 2013146918 | A1 | 10/2013 |
| WO | 2014146186 | A1 | 9/2014 |
| WO | 2015064001 | A1 | 5/2015 |
| WO | 2015145868 | A1 | 10/2015 |
| WO | 2017160787 | A2 | 9/2017 |

OTHER PUBLICATIONS

Department of Transportation, "Federal Motor Vehicle Safety Standards; Door Locks and Door Retention Components and Side Impact Protection, "http://www.nhtsa.gov/cars/rules/rulings/DoorLocks/DoorLocks_NPRM.html#VI_C, 23 pages, Aug. 28, 2010.
"Push Button to open your car door" Online video clip. YouTube, Mar. 10, 2010. 1 page.
Car of the Week: 1947 Lincoln convertible By: bearnest May 29, 2012 http://www.oldcarsweekly.com/car-of-the-week/car-of-the-week-1947-lincoln-convertible. 7 pages.
U.S. Appl. No. 14/276,415, Office Action dated Mar. 28, 2018, 19 pages.
U.S. Appl. No. 12/402,744, Office Action dated Oct. 23, 2013, 7 pages.
U.S. Appl. No. 12/402,744, Advisory Action dated Jan. 31, 2014, 2 pages.
U.S. Appl. No. 14/280,035, filed May 16, 2014, entitled "Powered Latch System for Vehicle Doors and Control System Therefor.".
U.S. Appl. No. 14/281,998, filed May 20, 2014, entitled "Vehicle Door Handle and Powered Latch System.".
U.S. Appl. No. 14/282,224, filed May 20, 2014, entitled "Powered Vehicle Door Latch and Exterior Handle With Sensor.".
George Kennedy, "Keyfree app replaces conventional keys with your smart phone," website, Jan. 5, 2015, 2 pages.
Hyundai Motor India Limited, "Hyundai Care," website, Dec. 8, 2015, 3 pages.
Keyfree Technologies Inc., "Keyfree," website, Jan. 10, 2014, 2 pages.
PRWEB, "Keyfree Technologies Inc. Launches the First Digital Car Key," Jan. 9, 2014, 3 pages.
U.S. Appl. No. 14/468,634, filed Aug. 26, 2014, 15 pages.
U.S. Appl. No. 13/608,303, filed Sep. 10, 2012, 15 pages.
U.S. Appl. No. 14/281,998, filed May 20, 2014, 20 pages.
U.S. Appl. No. 14/282,224, filed May 20, 2014, 15 pages.
U.S. Appl. No. 14/276,415, filed May 13, 2014, 18 pages.
Kisteler Instruments, "Force Sensors Ensure Car Door Latch is Within Specification," Article, Jan. 1, 2005, 3 pages.
General Motors Corporation, 2006 Chevrolet Corvette Owner Manual, ©2005 General Motors Corporation, 4 pages.
General Motors LLC, 2013 Chevrolet Corvette Owner Manual, 2012, 17 pages.
General Motors, "Getting to Know Your 2014 Corvette," Quick Reference Guide, 2013, 16 pages.
InterRegs Ltd., Federal Motor Vehicle Safety Standard, "Door Locks and Door Retention Components," 2012, F.R. vol. 36 No. 232—Feb. 12, 1971, 23 pages,.
Ross Downing, "Flow to Enter & Exit a Corvette With a Dead Battery," YouTube video http://www.youtube.com/watch?v=DLDqmGQU6L0, Jun. 6, 2011, 1 page.
Jeff Glucker, "Friends videotape man 'trapped' inside C6 Corette with dead battery," YouTube via Corvett Online video hittp://www.autoblog.com/2011/05/14/friends-videotape-man-trapped-inside-c6-corvette-with-dead-bat/, May 14, 2011, 1 page.
Don Roy, "ZR1 Owner Calls 911 After Locking Self in Car," website http://www.corvetteonline.com/news/zr1-owner-calls-911-after-locking-self-in-car/, Apr. 13, 2011, 2 pages.
Zach Bowman, "Corvette with dead battery traps would-be thief," website http://www.autoblog.com/2011/10/25/corvette-with-dead-battery-traps-would-be-thief/, Oct. 25, 2011, 2 pages.
Bryan Laviolette, "GM's New App Turns Smartphones into Virtual Keys," Article, Jul. 22, 2010, 2 pages.
Hyundai Bluelink, "Send Directions to your car," Link to App, 2015, 3 pages.
Office Action dated Mar. 10, 2017, U.S. Appl. No. 15/174,206, filed Jun. 6, 2016, 17 pages.

* cited by examiner

METHOD TO DETECT END-OF-LIFE IN LATCHES

FIELD OF THE INVENTION

The present invention generally relates to vehicle door latches and in particular to a counting mechanism that is utilized to determine if a latch is reaching its end-of-life.

BACKGROUND OF THE INVENTION

Motor vehicles typically include latch mechanisms that selectively retain the vehicle doors in a closed position. Existing latches may include a rotating claw that is configured to engage a striker and retain the door in a closed position when the latch is in a latched configuration. A pawl selectively prevents rotation of the claw from an engaged position to a disengaged position. In mechanical latches, the pawl may be mechanically connected to a movable door handle by linkage such that movement of the door handle shifts the pawl from an engaged position to a disengaged position to unlatch the latch. Powered latches have also been developed. Powered latches may include an electrically powered actuator that shifts the pawl from the engaged position to the disengaged position, thereby permitting movement of the claw when the powered latch is unlatched.

Due to wear encountered during operation of the latch, latches may fail after the latch has been used for a period of time. Failure due to wear may occur in both mechanical latches and powered latches.

SUMMARY OF THE INVENTION

One aspect of the present disclosure is a latch system for vehicle doors, deck lids, hatches, hoods, or other movable enclosures. The latch system includes a latch that is configured to shift between latched and unlatched configurations. The latch has a predicted life that may be based on a number of times the latch is used. The latch system further includes a sensor that generates signals that can be used to determine how many times the latch has been used. The system generates an end-of-life signal when the latch has reached the predicted life and/or when the latch is approaching the predicted life and/or when the latch has exceeded the predicted life. The system may include a controller that is operably connected to the sensor. The controller may be configured to alert a user that the latch is approaching an end-of-life condition, and/or that the latch has reached an end-of-life condition. The alert may comprise an audio alert and/or it may comprise a visual display (message) that is provided on a display screen in a vehicle interior.

Another aspect of the present disclosure is a door latch system for vehicle doors. The system includes a latch for vehicle doors. The latch has latched and unlatched configurations. In use, the latch cycles between the latched and unlatched configurations. The system includes a counting device that counts the number of cycles of the latch and/or the number of configuration changes from one of the latched and unlatched states to the other of the latched and unlatched states. The system further includes a controller that is operably connected to the counting device. The controller is configured to generate an end-of-life signal indicating that the latch has reached an end-of-life condition and/or is approaching an end-of-life condition. The controller generates the end-of-life signal based on predefined criteria. The predefined criteria may comprise at least one of an allowable number of cycles of the latch and/or an allowable number of configuration changes of the latch.

Another aspect of the present disclosure is a vehicle latch system including a vehicle door latch and a sensor that detects latch operations. The latch operations may include latching and/or unlatching of the latch. The system further includes a controller that is configured to generate an end-of-life signal if the controller determines that a predefined number of latch operations have occurred.

Embodiments of the first aspect of the invention can include any one or a combination of the following features:

- The latch may include a rotatable claw that is configured to engage a striker, and a pawl that engages the claw and prevents rotation of the claw when the latch is in a latched configuration. The sensor may be configured to detect movement and/or position of at least one of the claw and the pawl.
- The latch may include a rotatable claw that is configured to engage a striker, and a pawl that engages the claw and prevents rotation of the claw when the latch is in a latched configuration. The sensor may be configured to detect engagement and/or disengagement of the pawl with the claw.
- The door latch system may include a controller that is operably connected to the sensor, and the controller may be configured to generate an end-of-life signal.
- The door latch system may include a display that is operably connected to the controller, and the controller may be configured to cause the display to display a message indicating that the latch has reached its end-of-life and/or that the latch is approaching its end-of-life.
- The latch may include a rotatable claw that is configured to engage a striker, and a pawl that engages the claw and prevents rotation of the claw when the latch is in a latched configuration. The latch may include an electrically-powered actuator that is configured to shift the pawl between latched and unlatched positions to thereby unlatch the latch. The sensor may comprise a switch that detects engagement of the pawl with the claw and/or movement and/or position of the claw and/or the pawl.
- The latch may include a rotatable claw that is configured to engage a striker, and a pawl that engages the claw and prevents rotation of the claw when the latch is in a latched configuration. The latch may include a spring that is operably connected to the claw and/or the pawl such that spring cycles upon movement of the claw and/or the pawl. The spring may be configured to fail after a predefined number of cycles, and failure of the spring causes actuation of the sensor.
- The spring may comprise a torsion spring that is operably connected to the claw or the pawl.
- The spring may comprise a compression spring that is operably connected to the claw or the pawl.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
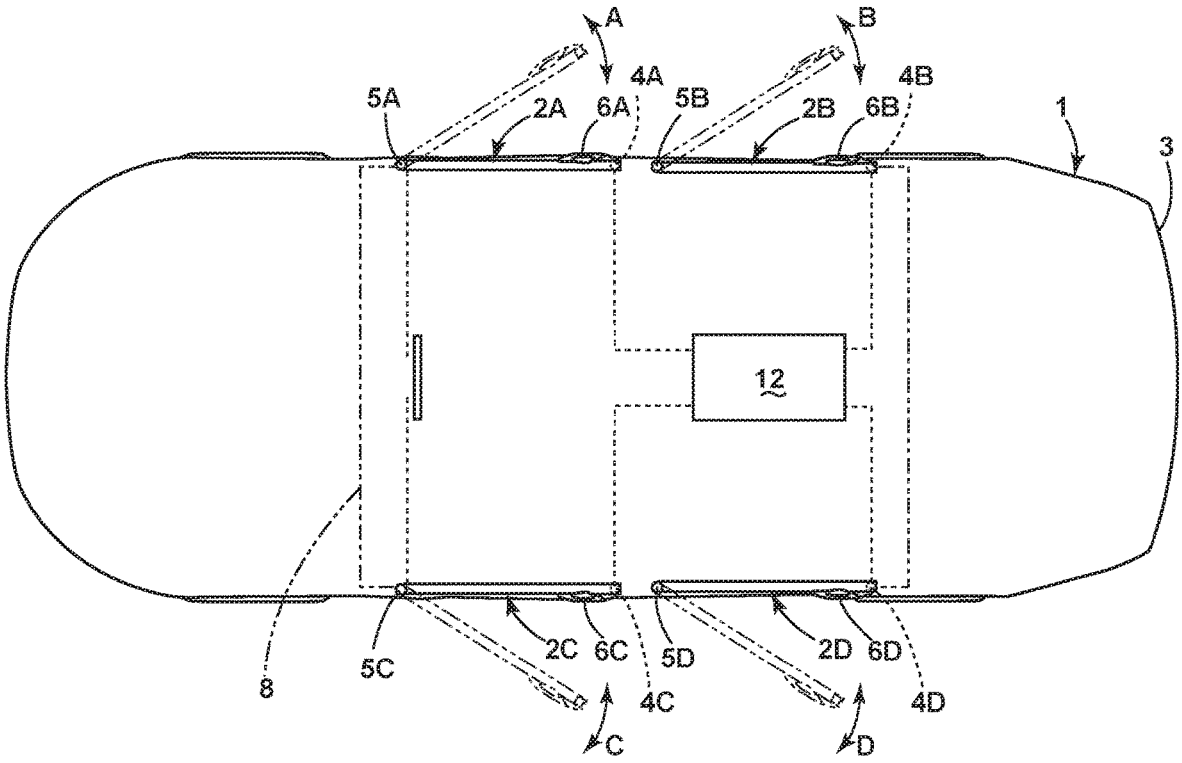
FIG. 1 is a schematic plan view of a vehicle including a plurality of doors and door latch systems.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a motor vehicle 1 may include a plurality of doors 2A-2D that are movably mounted to a vehicle body structure 3 by hinges 5A-5C, respectively for movement between open and closed positions as shown by the arrows A-D. Latches 4A-4D selectively retain the doors 2A-2D in a closed position. As discussed in more detail below, the latches 4A-4D may comprise mechanical latches that are mechanically connected to movable door handles 6A-6D by cables or other suitable linkage whereby movement of the handles 6A-6D unlatches the latches 4A-4D. It will be understood that each door 2A-2D may include both interior and exterior handles that are operably connected to the latches 4A-4D.

Alternatively, the latches 4A-4D may comprise powered latches having electrically powered actuators that shift the latches 4A-4D from a latched configuration to an unlatched configuration. If the latches 4A-4D comprise powered latches, the handles 6A-6D may comprise fixed, non-movable handles having sensors that detect the presence of a user's hand to thereby generate an unlatch request to a controller 12. If the door is in an unlocked state, the controller 12 generates a signal to cause the powered latch to unlatch. The vehicle 1 generally includes an interior space 8, and a user communication device such as a display 10 that is disposed in the interior space 8. As discussed in more detail below, the controller 12 may be configured to generate an audio signal and/or a visual display/message on display 10 to alert a user that one or more of the latches 4A-4D has reached its end-of-life and/or is approaching its end-of-life.

Figure 2:
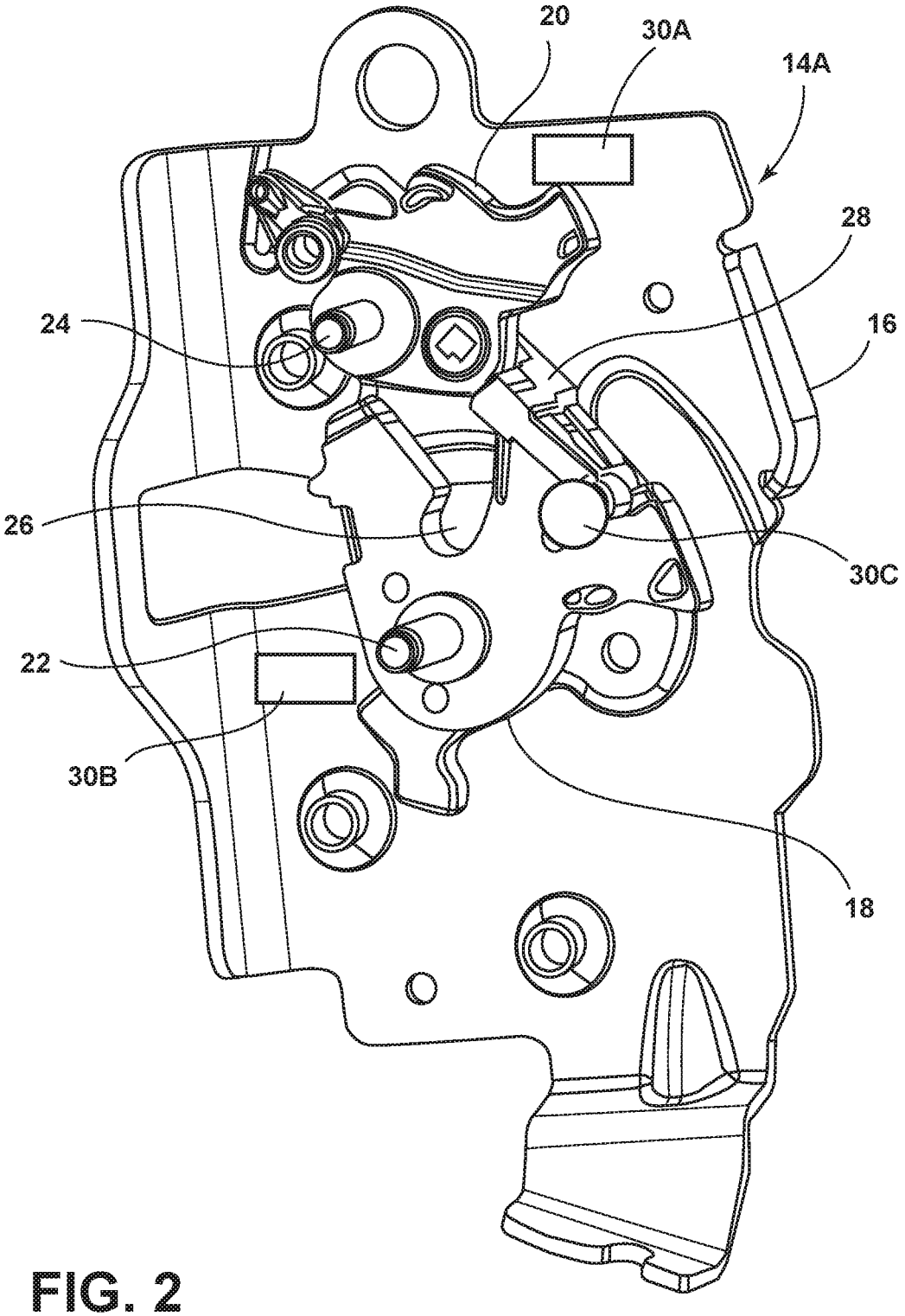
FIG. 2 is a partially schematic isometric view of a powered latch showing sensor locations for counting latch cycles.

With further reference to FIG. 2, a powered latch 14A includes a support structure such as a bracket 16 and a movable (rotatable) claw 18 that is rotatably mounted to the bracket 16 by a pivot member such as pin 22. A pawl 20 is rotatably mounted to the bracket 16 by a pivot member such as pin 24. The claw 18 includes a slot 26 that is configured to selectively engage a striker (not shown) mounted to the vehicle body structure 3 to selectively retain the doors 2A-2D in a closed position. When latch 14A is in an unlatched configuration, the pawl 20 is disengaged from claw 18 to thereby permit rotation of claw 18. However, when the latch 14A is in a latched configuration, the pawl 20 engages claw 18 to prevent rotation of claw 18. An electrically powered actuator 28 is configured to selectively rotate the pawl 20 between engaged and disengaged positions to thereby unlatch the latch 14A. The powered actuator 28 may be operably connected to the controller 12, and the controller 12 actuates powered actuator 28 upon receiving an unlatch request from one or more sensors on the door, a remote fob, or other user input device. The controller 12 may be configured to unlatch the latch 14A only if the door is in an unlocked state and/or if other predefined operating conditions are present. The basic operation of powered latches including a powered actuator, claw, and pawl are known in the art, and a more detailed description of the operation of latch 14A is therefore not believed to be required. Powered latches are disclosed in U.S. Pat. Nos. 9,834,964, 9,903,142, 9,909,344, 9,957,737, and 10,273,725, the entire contents of each being incorporated herein by reference.

Latch 14A includes one or more sensors 30A, and/or 30B, and/or 30C. Sensor 30A is configured to detect position and/or movement of pawl 20. Sensor 30B is configured to detect position and/or movement of claw 18, and sensor 30C is configured to detect actuation of powered actuator 28 and/or engagement of claw 18 with pawl 20. Sensors 30A-30C may comprise switches, proximity sensors, or other suitable devices. Sensors 30A-30C are shown in schematic form in FIG. 2. It will be understood that the actual form of the sensors 30A-30C will vary depending on the particular sensor/device that is utilized and the configuration of the latch components that are utilized for a particular application. Latch 14A may include only sensor 30A, only sensor 30B, or only sensor 30C. Alternatively, latch 14A may include two of the sensors 30A-30C in any combination, or latch 14A may include all three sensors 30A-30C. The sensors 30A-30C are operably connected to the controller 12, and provide a count of the number of cycles of latch 14A. In general, a cycle comprises movement of claw 18 and pawl 20 from a latched configuration to an unlatched configuration, and back to a latched configuration. Alternatively, a cycle may comprise a change from an unlatched configuration to a latched configuration, followed by a change from the latched configuration to unlatched configuration. Thus, a cycle includes two changes in the latch configuration, namely, a change in the configuration of latch 14A from a latched configuration to an unlatched configuration, and a change in the configuration of the latch 14A from an unlatched configuration to a latched configuration.

Latch 14A may be tested to determine the number of cycles the latch 14A can be used before failure, and the test data can be used to determine a predicted life of the latch 14A. In use, the controller 12 counts the number of cycles and/or changes in configuration, and generates an end-of-life signal when the latch 14A has been used a predefined number of times (e.g. cycles). The predefined number of times may be a number of cycles that corresponds to a predicted end-of-life of latch 14A. The predicted end-of-life of latch 14A may comprise a number that is determined statistically. For example, if numerous latches 14A are tested, a probability of failure as a function of a number of cycles may be developed (e.g. a normal distribution or other suitable/accurate curve), and the end-of-life count utilized to generate the end-of-life signal may comprise a number of cycles at which less than a selected percentage of latches will fail. For example, if testing shows that the latches 14A fail according to a normal distribution curve, the predicted life of the latch may comprise one, two, three, four, or more standard deviations from the median.

The controller 12 may be configured to cause display 10 (FIG. 1) to display a message such as "replace front driver's side latch" or other suitable end-of-life indicator. It will be understood that the vehicle 1 may also, or alternatively include speakers (not shown) that generate an audio message or warning that the end-of-life of the latches has been reached.

Figure 3:
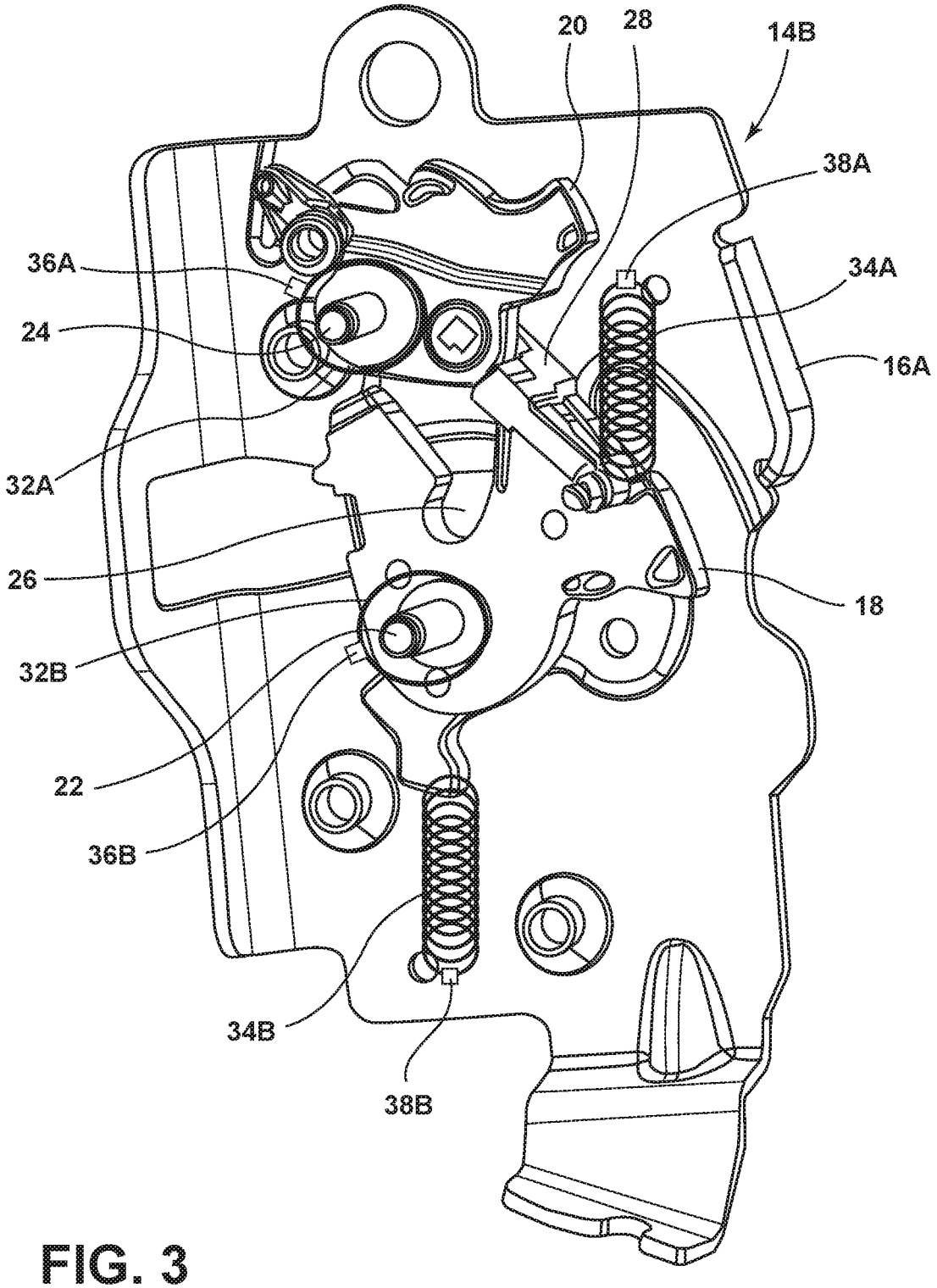
FIG. 3 is a partially schematic isometric view of a powered latch showing possible spring locations for sensors that detect spring failure.

With further reference to FIG. 3, a powered latch 14B according to another aspect of the present invention includes a claw 18, pawl 20, and electrically powered actuator 28 that shifts pawl 20 in substantially the same manner as discussed above in connection with FIG. 2. Powered latch 14B includes one or more torsion springs 32A, 32B and/or one or more compression springs 34A, 34B. Torsion spring 32A is operably connected to a sensor 36A, and the torsion spring 32A is compressed and extended upon rotation of pawl 20. Torsion spring 32A is configured to fail after a predefined number of cycles (i.e. rotations of pawl 20) before or when latch 14B reaches its predicted end-of-life. When torsion spring 32A fails, the failure causes sensor 36 to be actuated, thereby generating a signal to the controller 12. The controller 12 then causes display 10 to display an end-of-life signal. Latch 14B may, alternatively, include a torsion spring 32B and sensor 36B that operate in substantially the same manner as torsion spring 32A and sensor 36A to provide an end-of-life signal.

Latch 14B may include compression spring 34A and/or compression spring 34B that are operably connected to switches or sensors 38A and 38B, respectively. Compression springs 34A and 34B are configured to fail after a predefined number of cycles corresponding to a predicted life of latch 14B to thereby cause switches or sensors 38A or 38B to generate a signal to controller 12 indicating that the latch 14B has reached its end-of-life. Compression spring 34A may be configured to flex upon rotation of claw 18 and/or pawl 20, and compression spring 34B may be configured to extend and compress upon rotation of claw 18. Latch 14B may include a single spring and sensor, or the latch 14B may include two or more springs and sensors.

The spring or springs may be tested to determine a predicted number of cycles at which the spring will fail, and may be designed based on the testing to fail prior to failure of latch 14B based on suitable statistical criteria.

Figure 4:
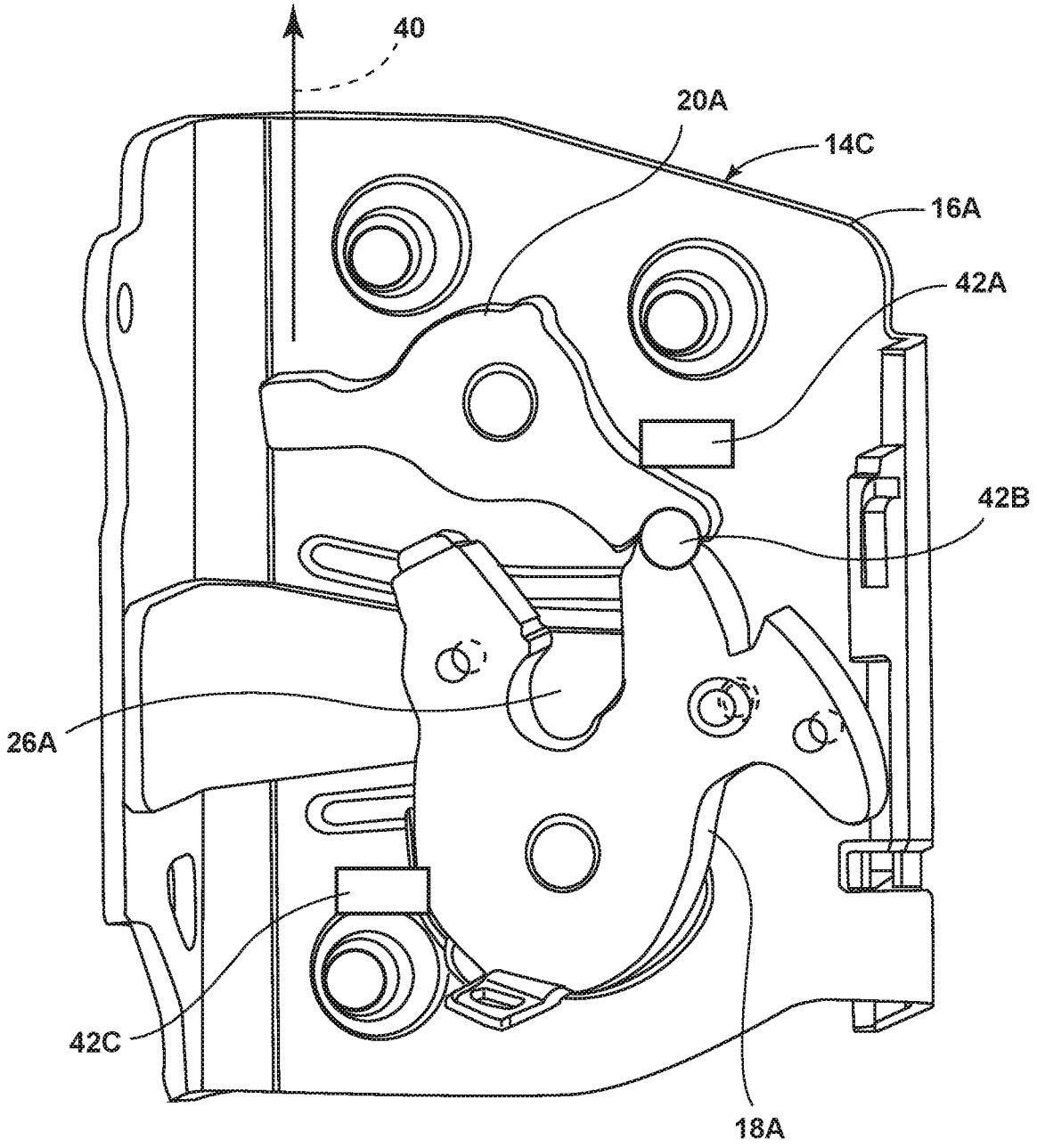
FIG. 4 is a partially schematic isometric view of a mechanical latch showing sensor locations for counting latch cycles.

With further reference to FIG. 4, a mechanical latch 14C includes a mounting structure/bracket 16A, and a claw 18A and pawl 20A that are rotatably mounted to the bracket 16A. Claw 18A includes a slot 26A that is configured to selectively engage a striker (not shown) mounted on vehicle body structure 3 to selectively retain a door in a closed position. Pawl 20A is mechanically connected to a door handle 6A-6C (FIG. 1) by a mechanical linkage 40, such that movement of the door handle shifts the pawl 20A from an engaged position preventing rotation of claw 18A to an unlatched configuration permitting rotation of claw 18A. This aspect of latch 14C is known in the art, such that a detailed description is not believed to be required.

Latch 14C includes one or more sensors 42A-42C that are operably connected to controller 12. Sensor 42A is configured to detect position and/or movement of pawl 20A, and sensor 42B is configured to detect engagement of pawl 20A and claw 18A. Sensor 42C is configured to detect position and/or movement of claw 18A. Latch 14C may include one sensor (i.e. one of the sensors 42A, 42B, or 42C), or the latch 14C may include two or more of the sensors 42A-42C.

The sensors 42A-42C generate signals to controller 12 that can be utilized to determine the number of cycles latch 14C has experienced. Controller 12 is configured (e.g. programmed) to generate an end-of-life signal when the number of cycles reaches a number corresponding to predefined end-of-life criteria of latch 14C. The end-of-life criteria may comprise statistical criteria as discussed above. The end-of-life signal generated by controller 12 may cause the display 10 to display a message, or the end-of-life signal may cause the vehicle 1 to generate an audio signal to a user indicating that the latch has reached its end-of-life.

Figure 5:
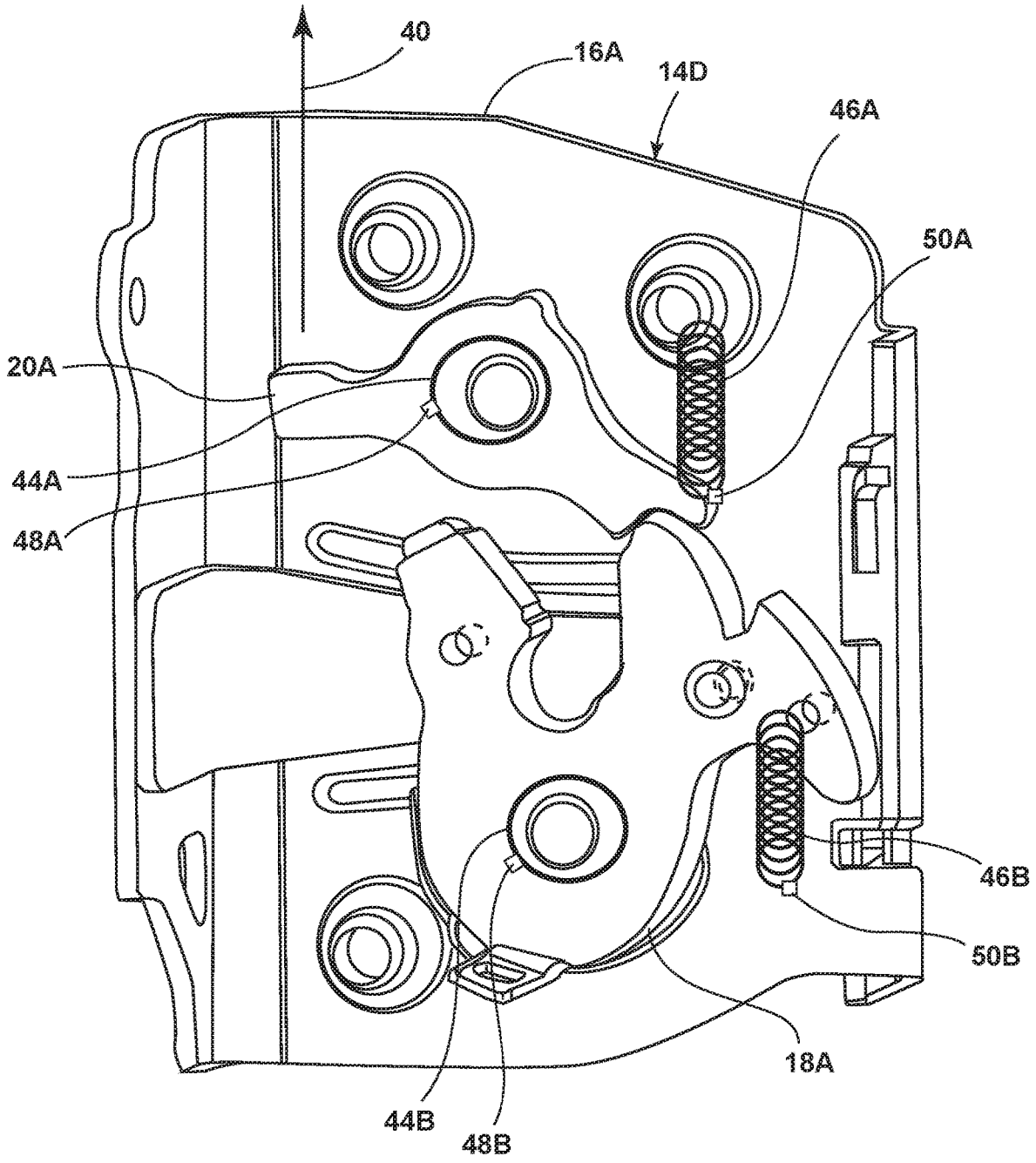
FIG. 5 is a partially schematic isometric view of a mechanical latch showing possible spring locations for sensors that detect spring failure.

With further reference to FIG. 5, a mechanical latch 14D includes a pawl 20A and claw 18A that operate in substantially the same manner as discussed above in connection with the latch 14C of FIG. 4. Latch 14D may include a torsion spring 44A and sensor 48A, a torsion spring 44B and sensor 48B, a compression spring 46A and sensor 50A and/or a compression spring 46B and sensor 50B. The springs 44A, 44B, 46A, 46B are configured to fail after a predefined number of cycles to thereby cause a sensor 48A, 48B, 50A, or 50B to generate a signal to controller 12. Controller 12 then generates an end-of-life signal, which may cause display 10 to display an end-of-life message to alert a user that the latch has reached its end-of-life. It will be understood that latch 14D may include a single spring and sensor, or it may include two or more springs and sensors.

The door latch system of the present disclosure provides a count device that can be utilized to determine when a vehicle door latch has reached its end-of-life, or is about to reach its end-of-life. This permits the latch to be replaced before the latch reaches its end-of-life and fails.

Although the present disclosure refers to a door latch, it will be understood that the counting device may be utilized to predict the end-of-life of other latches utilized to retain vehicle closure members in closed positions, including latches utilized to retain deck lids, hatches, or hoods of motor vehicles. Still further, the counting device may be utilized in connection with conventional rotating vehicle doors, or it may be utilized in connection with latches for sliding doors utilized in vans or other such vehicles.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A door latch system for vehicle doors, comprising:

a latch for vehicle doors that is configured to shift between latched and unlatched configurations, wherein the latch includes a spring and a rotatable claw that is configured to engage a striker, and a pawl that engages the claw and prevents rotation of the claw when the latch is in a latched configuration, wherein the spring is operably connected to the claw and/or the pawl such that the spring cycles upon movement of the claw and/or the pawl, the latch having a predicted life based on a number of times the latch is used;

a sensor that generates one or more signals that can be used to determine if the latch has reached a predefined end-of-life criteria;

wherein the spring is configured to fail after a predefined number of cycles, and wherein failure of the spring causes actuation of the sensor; and:

wherein the system is configured to generate an end-of-life signal based on the one or more signals from the sensor when the signals indicate that the latch has reached the predefined end-of-life criteria.

2. The door latch system of claim 1, wherein:

the latch includes a rotatable claw that is configured to engage a striker, and a pawl that engages the claw and prevents rotation of the claw when the latch is in a latched configuration; and the sensor is configured to detect movement and/or position of at least one of the claw and the pawl.

3. The door latch system of claim 1, wherein:

the latch includes a rotatable claw that is configured to engage a striker, and a pawl that engages the claw and prevents rotation of the claw when the latch is in a latched configuration; and wherein the sensor is configured to detect engagement and/or disengagement of the pawl with the claw.

4. The door latch system of claim 1, including:

a controller operably connected to the sensor, wherein the controller is configured to generate an end-of-life signal when the predefined end-of-life criteria exists.

5. The door latch system of claim 4, including:

a display that is operably connected to the controller; and wherein the controller causes the display to display a message indicating that the latch has reached its end-of-life and/or that the latch is approaching its end-of-life.

6. The door latch system of claim 1, wherein:

the latch includes an electrically-powered actuator that is configured to shift the pawl between latched and unlatched positions to thereby unlatch the latch; and the sensor comprises a switch that detects engagement of the pawl with the claw and/or movement and/or position of the claw and/or the pawl.

7. The door latch system of claim 1, wherein:

the spring comprises a torsion spring that is operably connected to the claw or the pawl.

8. The door latch system of claim 1, wherein:

the spring comprises a compression spring that is operably connected to the claw or the pawl.

9. A door latch system for vehicle doors comprising:

a latch for vehicle doors having latched and unlatched configurations, wherein, in use, the latch cycles between the latched and unlatched configuration;

a counting device that counts the number of cycles of the latch and/or the number of configuration changes from one of the latched and unlatched states to the other of the latched and unlatched states;

a controller that is operably connected to the counting device, the controller being configured to generate an end-of-life signal indicating that the latch has reached an end-of-life condition and/or is approaching an end-of-life condition, wherein the controller generates the end-of-life signal based on predefined criteria, the predefined criteria comprising at least one of an allowable number of cycles of the latch and/or an allowable number of configuration changes of the latch.

10. The door latch system of claim 9, wherein:

the latch includes a rotatable claw and a pawl that selectively engages the claw to prevent rotation of the claw when the latch is in the latched configuration;

the counting device comprises a switch that engages the claw and/or the pawl.

11. The door latch system of claim 10, wherein:

the latch includes an electrically-powered actuator that shifts the pawl between latched and unlatched configurations.

12. The door latch system of claim 10, including:

a movable door handle that is mechanically connected to the pawl such that movement of the door handle moves the pawl to a disengaged position to unlatch the door.

13. The door latch system of claim 9, wherein:

the counting device comprises a spring that is configured to fail after a predefined number of cycles before the latch reaches the end-of-life condition, and a switch that is actuated when the spring fails.

14. A vehicle latch system, comprising:

a vehicle door latch;

a sensor that detects latch operations including latching and/or unlatching of the latch;

a controller configured to generate an end-of-life signal if the controller determines that a predefined number of latch operations has occurred.

15. The vehicle latch system of claim 14, wherein:

the sensor comprises a switch that is actuated when the latch is latched and/or when the latch is unlatched.

16. The vehicle latch system of claim 14, wherein:

the latch includes a spring that is configured to fail after a predefined number of cycles corresponding to a predicted end-of-life of the latch, and wherein failure of the spring actuates the sensor.

17. The vehicle latch system of claim 16, wherein:

the spring comprises a torsion spring or a compression spring.

18. The vehicle latch system of claim 14, wherein:

the latch includes a rotatable claw and a pawl that selectively engages the claw to prevent rotation of the claw when the latch is in the latched configuration; and wherein the sensor is configured to sense position and/or movement of the claw and/or the pawl.

19. The vehicle latch system of claim 18, wherein:

the latch includes a powered actuator that moves the pawl from a latched position to an unlatched position.

* * * * *